US007452216B2

(12) United States Patent
Murr et al.

(10) Patent No.: US 7,452,216 B2
(45) Date of Patent: Nov. 18, 2008

(54) TRANSCEIVER RECEPTACLE ASSEMBLY

(75) Inventors: Keith McQuilkin Murr, York, PA (US); Michael Eugene Shirk, Grantville, PA (US); Michael J. Phillips, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/728,631

(22) Filed: Mar. 27, 2007

(65) Prior Publication Data

US 2008/0242127 A1 Oct. 2, 2008

(51) Int. Cl.
*H01R 12/00* (2006.01)

(52) U.S. Cl. ..... 439/74; 439/79; 439/607

(58) Field of Classification Search ..... 439/79, 439/607, 541.5, 74; 385/92; 361/816, 818; D13/133

See application file for complete search history.

(56) References Cited

U.S. PATENT DOCUMENTS 6,469,905 B1 * 10/2002 Hwang ..... 361/756
6,511,345 B1 * 1/2003 Hwang ..... 439/541.5
6,558,191 B2 * 5/2003 Bright et al. ..... 439/541.5
6,729,905 B1 5/2004 Hwang et al.
6,824,429 B2 * 11/2004 Hwang ..... 439/607
6,866,544 B1 * 3/2005 Casey et al. ..... 439/607

* cited by examiner

*Primary Examiner*—Tho D. Ta
*Assistant Examiner*—Vanessa Girardi

(57) ABSTRACT

A receptacle assembly for a transceiver module includes a transceiver cage that is configured to receive the transceiver module. The transceiver cage is configured to be mounted proximate a cutout in a circuit board such that a portion of the transceiver cage extends through the cutout. A connector is configured to mate with the transceiver module and is disposed within the cage. The transceiver cage and the connector are configured to be mounted on the same surface of a circuit board.

16 Claims, 8 Drawing Sheets

TRANSCEIVER RECEPTACLE ASSEMBLY

BACKGROUND OF THE INVENTION

The invention relates generally to connector receptacles for use in networking applications and, more particularly, to a cage assembly for pluggable transceiver modules.

Transceiver modules are used for making bi-directional connections to communication devices such as modems, network interfaces, and other electronic modules or electrical systems such as computer systems and the like. The transceiver modules have mating ends that plug into host connectors that are mounted on a circuit board. The host connectors are housed in cages that provide shielding against electromagnetic interference (EMI). The cages receive the transceiver modules and guide the transceiver modules into mating engagement with the host connector.

Along with the general trend toward faster, higher performance electrical systems, particularly with regard to computer systems, there is an ongoing trend toward the development of higher density interconnect components. It is well known that industry standards are often developed to standardize or define the type of connectors used to interface components such as transceivers with other communication devices. One such standard is the Small Form-Factor Pluggable (SFP) standard that includes specifications for transceivers that are reduced in size to achieve a higher port density over a prior well known standard, the Gigabit Interface Converter Module (GBIC).

A stacked cage and connector system is sometimes used to increase transceiver density on the circuit board, wherein transceivers are arranged in rows and columns with each transceiver module plugged into a host connector in the cage. Notwithstanding the stacked cage systems, there is an ongoing need to minimize space requirements for mounting transceiver modules, such as through the implementation of the Advanced Mezzanine Card (AMC) standards for half-height card modules. It is therefore desirable to provide a cost effective low profile SFP cage assembly that complies with the AMC half-height card module standard.

BRIEF DESCRIPTION OF THE INVENTION

In one embodiment, a receptacle assembly for a transceiver module is provided. The receptacle assembly includes a transceiver cage that is configured to receive the transceiver module. The transceiver cage is configured to be mounted proximate a cutout in a circuit board such that a portion of the transceiver cage extends through the cutout. A connector is configured to mate with the transceiver module and is disposed within the cage. The transceiver cage and the connector are configured to be mounted on the same surface of a circuit board.

Optionally, the transceiver cage includes an outer shell having a top wall and opposite side walls. The outer shell is configured to be mounted over the cutout in the circuit board. An inner shell has a bottom wall and opposite side walls. The inner shell is received within the side walls of the outer shell and attached to the outer shell such that the inner shell extends at least partially through the cutout in the circuit board. The inner and outer shells cooperate to define a cavity configured to receive the transceiver module.

Alternatively, the cutout is formed in a main circuit board and the connector and the transceiver cage are mounted on an adapter circuit board. A board-to-board connector is configured to electrically connect the main circuit board and the adapter circuit board. The main circuit board and the adapter circuit board are arranged in a substantially parallel relationship.

In another embodiment, a receptacle assembly for a transceiver module includes a circuit board having a cutout defined therein. A transceiver cage is configured to receive the transceiver module and is mounted proximate the cutout in the circuit board such that a portion of the transceiver cage extends through the cutout. A connector is configured to mate with the transceiver module and is disposed within the transceiver cage. The transceiver cage and the connector are configured to be mounted on the same surface of a circuit board.

DETAILED DESCRIPTION OF THE INVENTION

Figure 1:
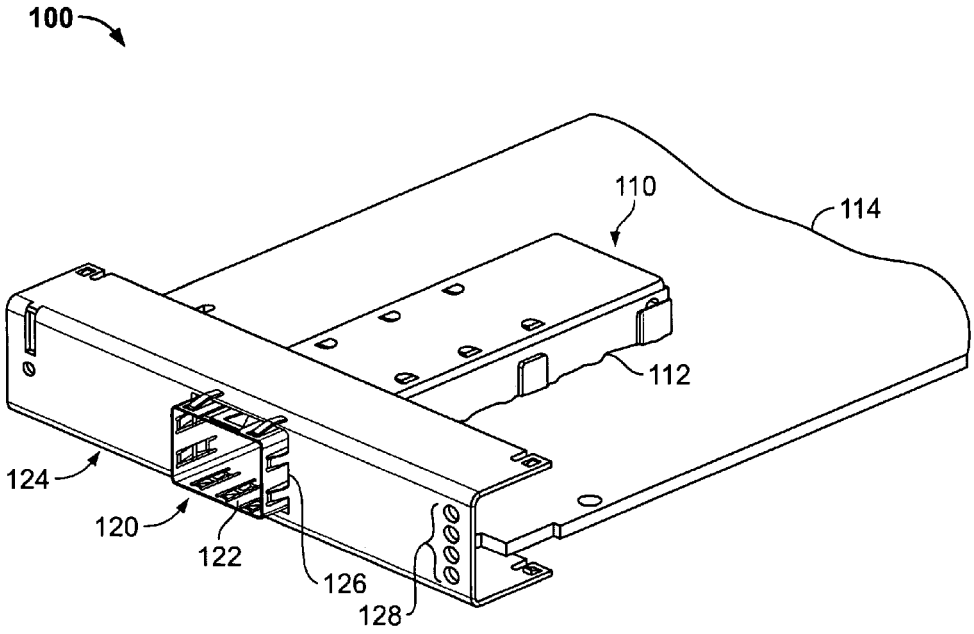
FIG. 1 is a perspective view of an electrical assembly formed in accordance with an exemplary embodiment of the present invention.

FIG. 1 illustrates a perspective view of an electrical assembly 100 formed in accordance with an exemplary embodiment of the present invention. The electrical assembly 100 includes a transceiver cage assembly 110 that is mounted within a cutout 112 in a circuit board 114. The invention will be described with reference to the one-by-one cage assembly as illustrated; however it is to be understood that that the benefits of the invention are also applicable to other cage arrangements such as one-by-N or stacked two-by-N cage arrangements.

The cage assembly 110 has a module receiving end 120 having an opening 122 that receives a transceiver module (not shown). A bezel or face plate 124 includes an opening 126 through which the module receiving end 120 of the cage assembly 110 extends. The face plate 124 includes a number of apertures 128 that may be used, for instance, to display LED indicators. As illustrated in FIG. 1, the face plate 124 is a single width, single height face plate, while the electrical assembly 100 conforms to half-height Advanced Mezzanine Card (AMC) standards.

Figure 2:
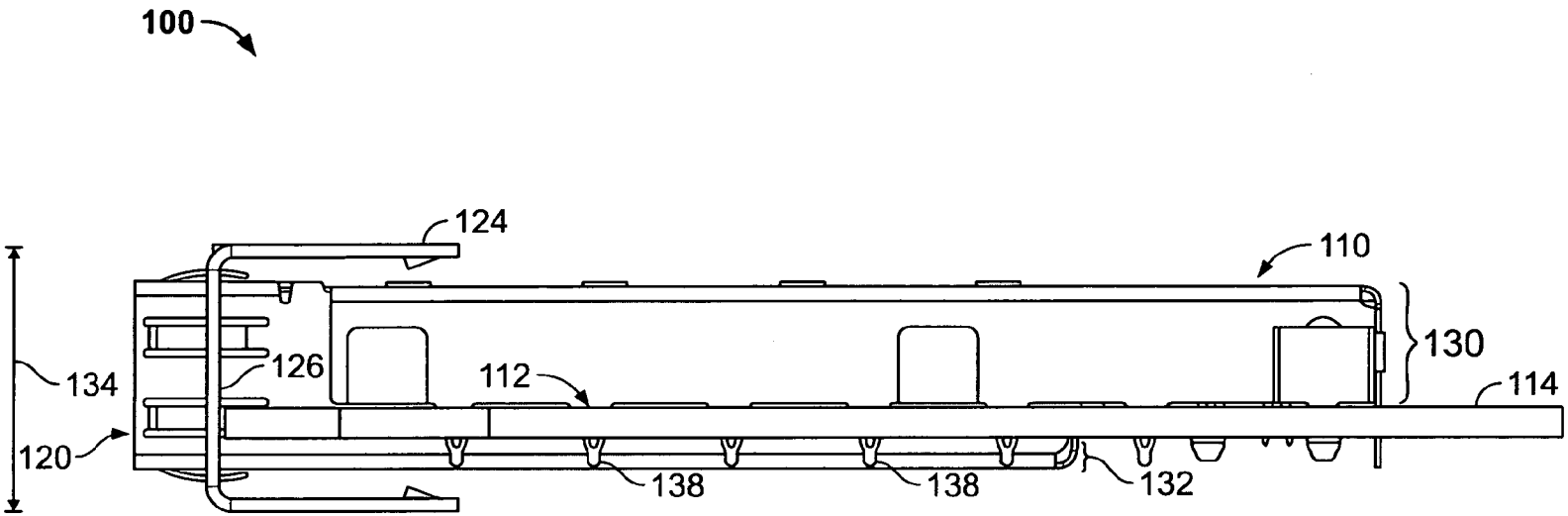
FIG. 2 is a side elevational view of the electrical assembly shown in FIG. 1.

FIG. 2 illustrates a side elevational view of the electrical assembly 100. The cage assembly 110 is mounted within the cutout 112 in the circuit board 114 such that a portion 130 of the cage assembly 110 extends above the circuit board 114 and a portion 132 of the cage assembly 110 extends below the circuit board 114. AMC standards define the height 134 of the face plate 124 and also the positioning of the face plate 124 relative to the circuit board 114. The cage assembly 110 is positioned within the cutout 112 such that the cage assembly 110 is centered in the face plate opening 126. The cage assembly 110 is provided with mounting pins 138 that, in one embodiment, facilitate press fit mounting of the cage assembly 110 on the circuit board 114.

Figure 3:
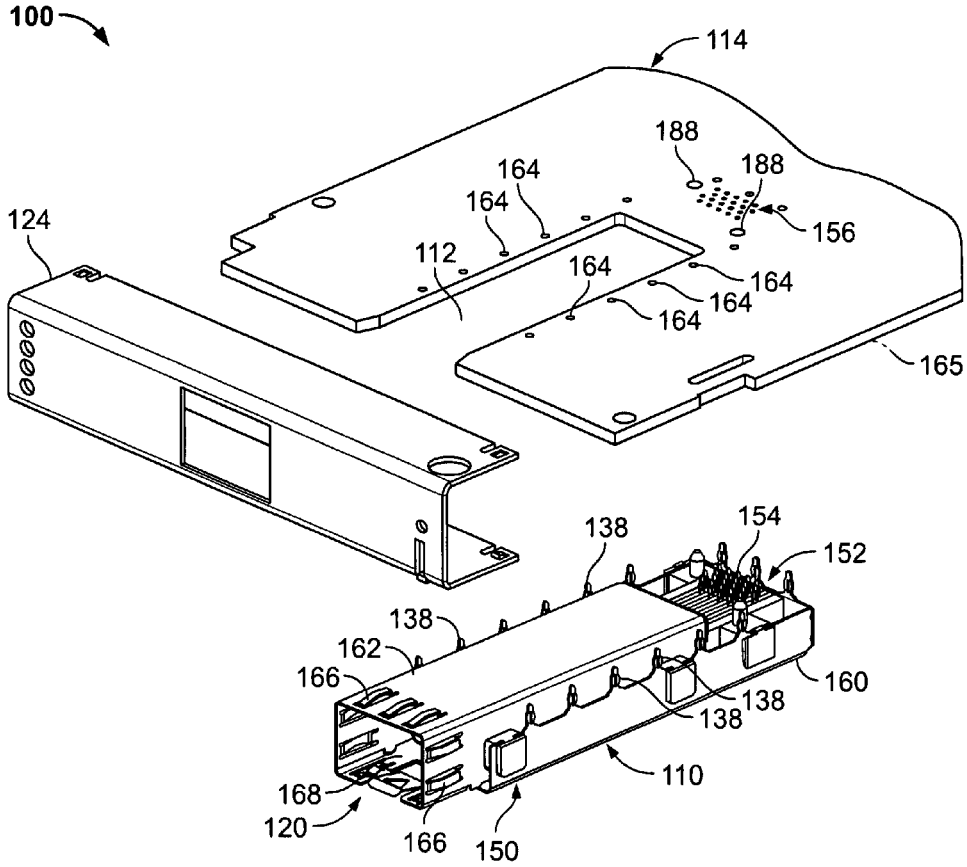
FIG. 3 is an exploded view of the electrical assembly shown in FIG. 1.

FIG. 3 illustrates an exploded view of the electrical assembly 100. In FIG. 3, the assembly 100 is inverted relative to the view shown in FIG. 1. The cage assembly 110 includes a shielding cage 150 and a pluggable transceiver connector 152. The connector 152 includes mounting pins 154 that are received in mounting apertures 156 in the circuit board 114 to mount and electrically connect the connector 152 to the circuit board 114. The cage 150 is fabricated from a conductive material and includes an outer shell 160 and an inner shell 162 that is attached to the outer shell 160. The cage 150 provides a barrier to isolate a transceiver module held therein from electromagnetic interference. The outer shell 160 includes the mounting pins 138 that are securely received in mounting apertures or vias 164 along the edges of the cutout 112 in the circuit board 114 to mount the cage 150 to the circuit board 114. The connector 152 and the outer shell 160 mount to the same side or surface 165 of the circuit board 114. In an exemplary embodiment, the cage 150 is electrically connected to a ground plane in the circuit board 114. A plurality of spring fingers 166 are formed at the module receiving end 120 of the cage 150 to retain the face plate 124 on the cage 150 and to provide a grounding connection to the face plate 124. The outer shell 160 is positioned over the cutout 112 such that the inner shell 162 extends partially through the cutout 112 when the cage 150 is mounted to the circuit board 114. The cage 150 defines a cavity 168 that is dimensioned to receive a transceiver module (not shown).

Figure 4:
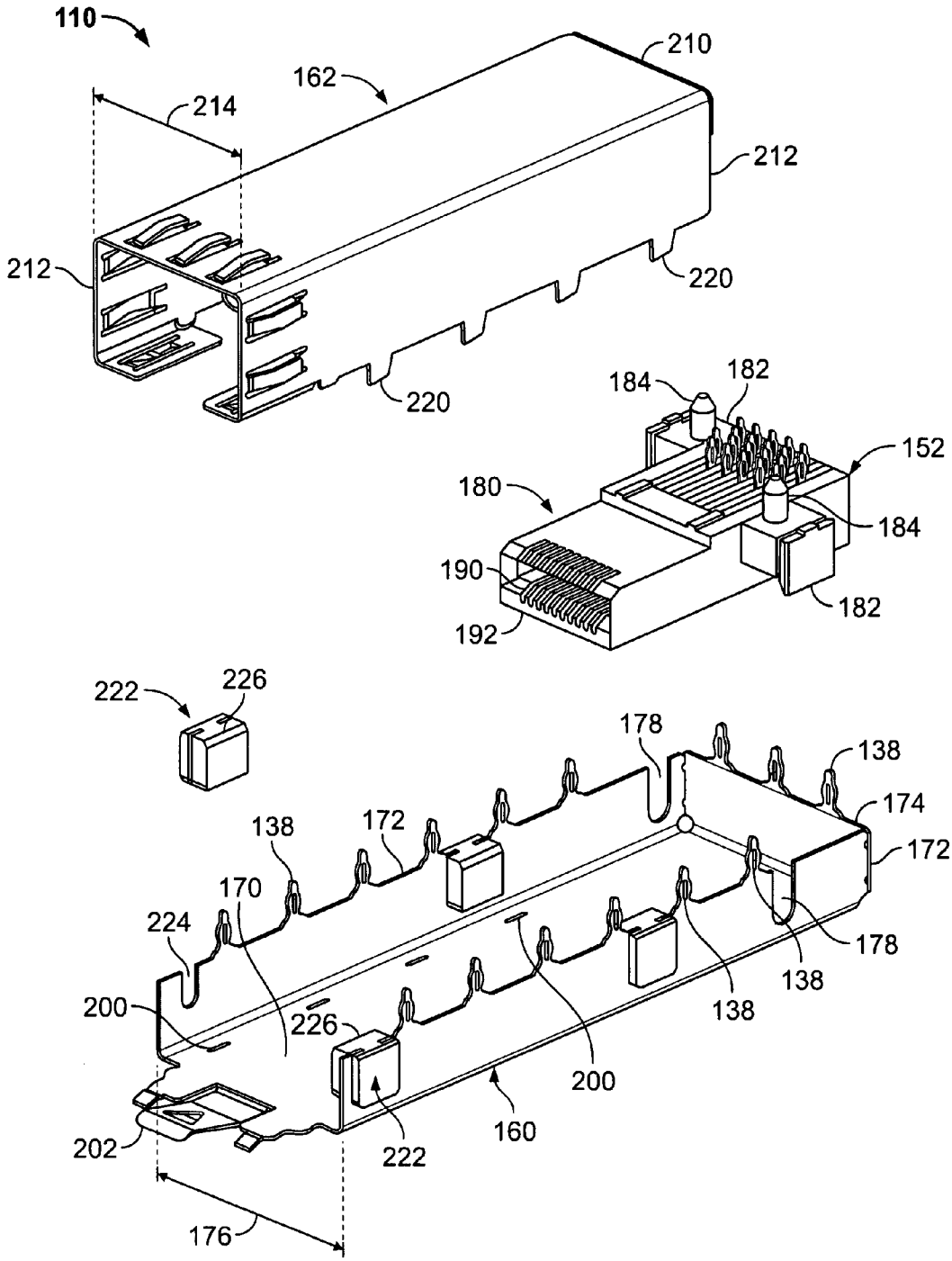
FIG. 4 is an exploded view of the cage assembly shown in FIG. 3.
Figure 5:
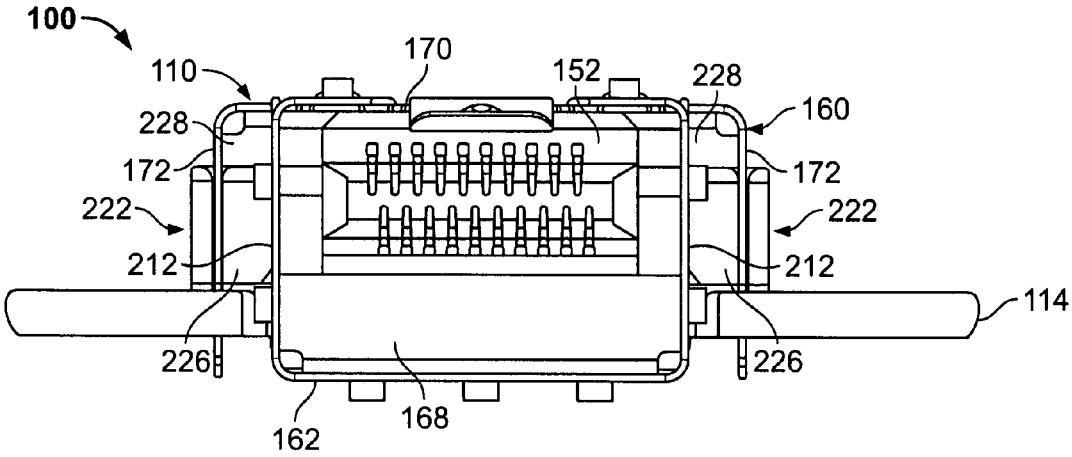
FIG. 5 is a front elevational view of the electrical assembly shown in FIG. 1.

FIG. 4 illustrates an exploded view of the cage assembly 110. FIG. 5 illustrates a front elevational view of the electrical assembly 100. The cage assembly 110 includes the outer shell 160, the inner shell 162, and the pluggable transceiver connector 152. The outer shell 160 includes a top wall 170, opposite side walls 172, and a rear wall 174. The side walls 172 and rear wall 174 extend perpendicularly from the top wall 170. The mounting pins 138 are formed on the side walls 172 and rear wall 174. The outer shell has a width 176 between the side walls 172. Slots 178 are provided at a rearward end of the side walls 172. The slots 178 are located so that one slot 178 is closer to the rear wall 174 than the other slot 178.

The connector 152 includes a housing 180 having positioning lugs 182 formed thereon, a portion of which is received in each slot 178 to orient and hold the connector in the outer shell 160. Mounting posts 184 are formed on the positioning lugs 182. The mounting posts 184 are received in apertures 188 (FIG. 3) in the circuit board 114 to locate the connector 152 on the circuit board 114. In one embodiment, the connector 152 is a card edge connector having contacts 190 that extend into a slot at a mating end 192 of the connector 152. The connector 152 is configured to receive a plug-in card edge on the transceiver module (not shown) as is well known in the art.

The top wall 170 of the outer shell 160 includes a plurality of slits 200 formed proximate the side walls 172 to facilitate assembly of the inner shell 162 to the outer shell 160. A transceiver latch member 202 is formed at a forward end of the top wall 170. The latch member 202 is configured to engage a latch element on the transceiver module (not shown). The latch member 202 is operable to lock and release the transceiver module in the cage assembly 110.

The inner shell 162 includes a bottom wall 210 and opposite side walls 212 that extend perpendicularly from the bottom wall 210. The inner shell 162 has a width 214 between the side walls 212 that is less than the width 176 of the outer shell 160. A plurality of tabs 220 are formed along each side wall 212. The inner shell 162 is received within the side walls 172 of the outer shell 160. The tabs 220 are received in the slits 200 in the outer shell 160 and extend through the top wall 170 and are folded over to attach the inner shell 162 to the outer shell 160. The inner shell 162 and the outer shell 160 cooperate to form the cavity 168 that receives the transceiver module (not shown).

A plurality of spacers 222 are mounted in slots 224 formed in the side walls 172 of the outer shell 160. Each spacer has a portion 226 that is disposed between the side walls 212 of the inner shell 162 and the side walls 172 of the outer shell 160 such that a gap 228 is formed between the side walls 212 of the inner shell and the side walls 172 of the outer shell 160. The spacers 222 position the inner shell 162 within the outer shell 160 and add rigidity to the cage assembly 110. The gap 228 may be used for light pipe channels on one or both sides of the cage assembly 110.

Figure 6:
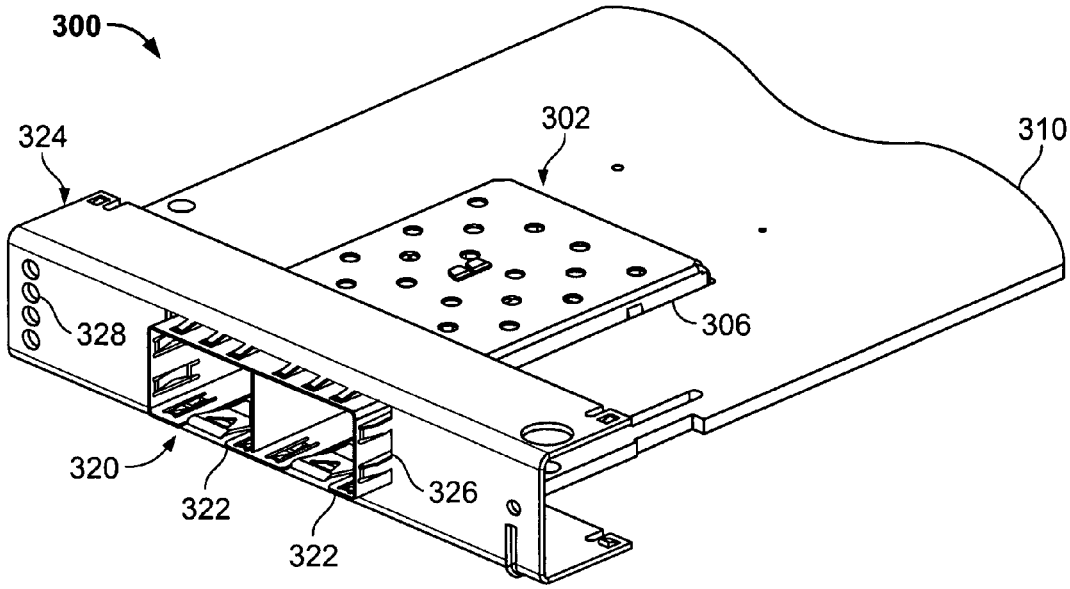
FIG. 6 is a perspective view of an electrical assembly formed in accordance with an alternative embodiment of the present invention.

FIG. 6 illustrates a perspective view of an electrical assembly 300 formed in accordance with an alternative embodiment of the present invention. The electrical assembly 300 includes a transceiver cage assembly 302 that is mounted within a cutout 306 in a main circuit board 310. The transceiver cage assembly 302 is a one-by-two cage assembly; however it is to be understood that that the benefits of the invention are also applicable to other cage arrangements such as one-by-N or stacked two-by-N cage arrangements.

The cage assembly 302 has a module receiving end 320 having openings 322 each of which receives a transceiver module (not shown). A face plate 324 includes an opening 326 through which the module receiving end 320 of the cage assembly 302 extends. The face plate 324 may include apertures 328 that may be used, for instance, to display LED indicators. The face plate 324 conforms to Advanced Mezzanine Card (AMC) standards for a single height face plate while the cage assembly 302 conforms to AMC standards for a half-height card module.

Figure 7:
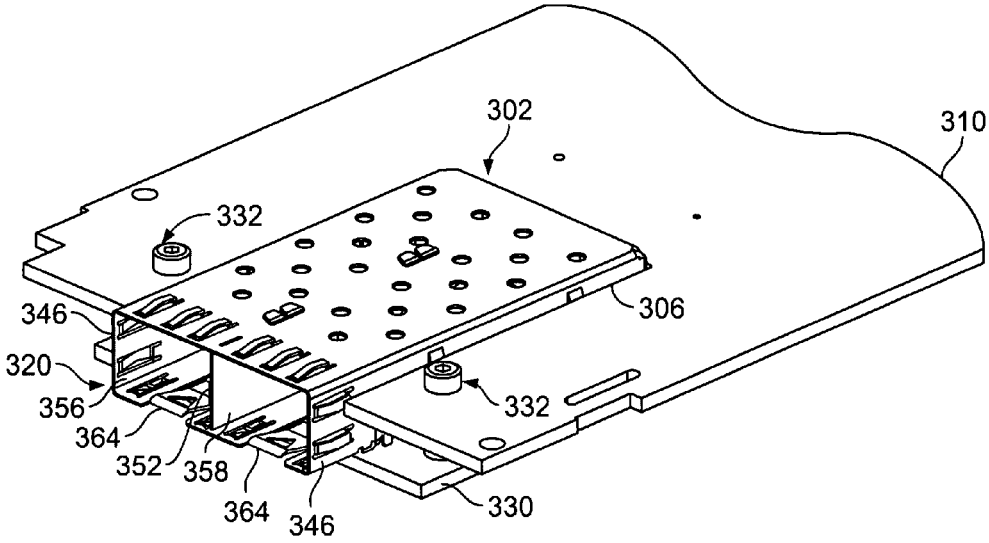
FIG. 7 is a perspective view of the assembly shown in FIG. 6 with the face plate removed.
Figure 8:
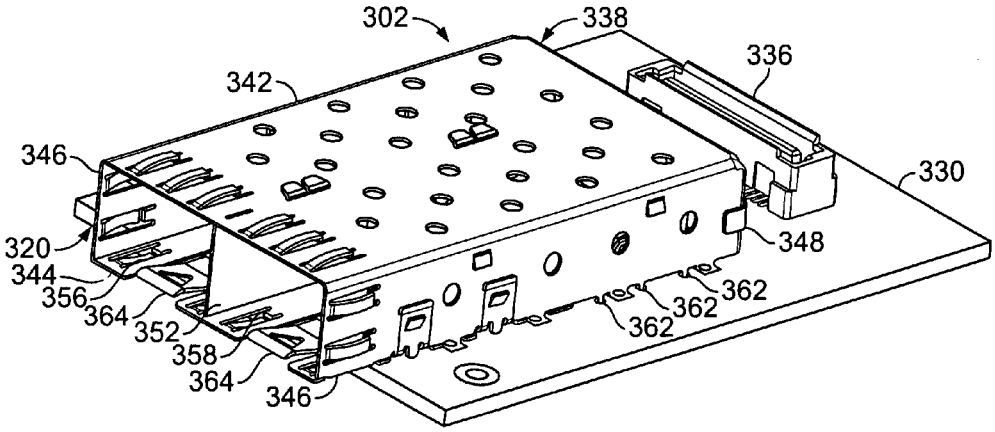
FIG. 8 is a perspective view of the adapter board and cage assembly shown in FIG. 7.

FIG. 7 illustrates a perspective view of the assembly 300 with the face plate 324 removed to reveal a second or adapter board 330 to which the cage assembly 302 is directly mounted. FIG. 8 illustrates a perspective view of the cage assembly 302 and adapter board 330. Standoff hardware 332 is provided proximate the module receiving end 320 of the cage assembly 302 to position the forward end of the cage assembly 302 relative to the main circuit board 310 according to AMC standards. A board-to-board connector 336 at a rearward end 338 of the cage assembly 302 is configured to mate with a mating connector 374 (FIG. 9) on the main board 310 to electrically connect the adapter board 330 to the main board 310.

The cage assembly 302 is fabricated from a conductive material and includes a top wall 342, a bottom wall 344, and opposite side walls 346 formed in a rectangular shape. A rear wall 348 closes the rearward end 338 of the cage assembly 302. A dividing wall 352 divides the interior of the cage assembly 302 into two transceiver cavities 356 and 358, each of which is configured to receive a transceiver module (not shown). Mounting pins 362 extend downwardly from each side wall 346 for mounting the cage assembly 302 to the adapter board 330. In some embodiments, the mounting pins 362 electrically connect the cage assembly 302 to a ground plane in the adapter board 330. Each transceiver cavity 356 and 358 is provided with a latch member 364 that engages a latch element on the transceiver module to lock the transceiver module in the cage assembly 302 or release the transceiver module from the cage assembly 302.

Figure 9:
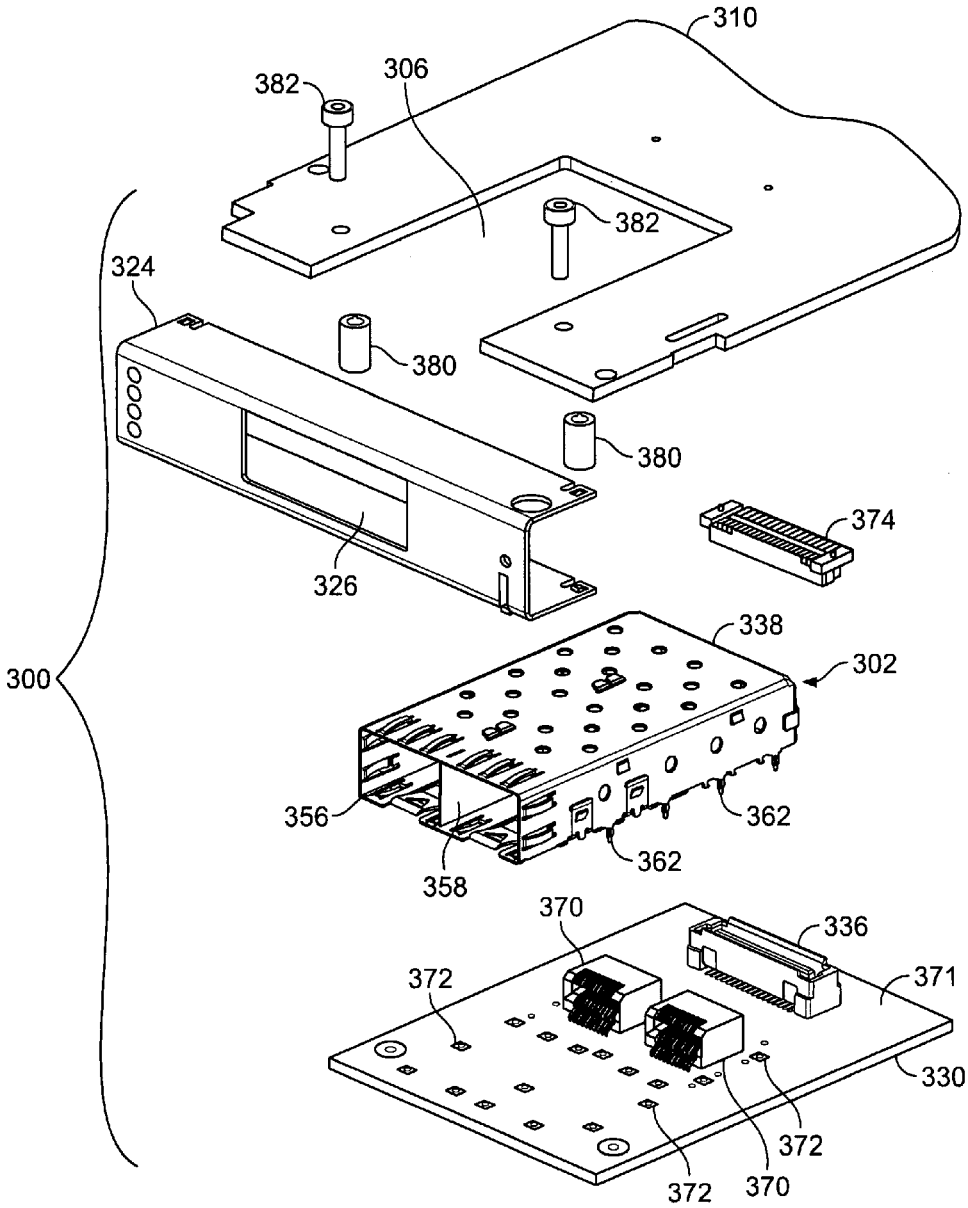
FIG. 9 is an exploded view of the electrical assembly shown in FIG. 6.
Figure 10:
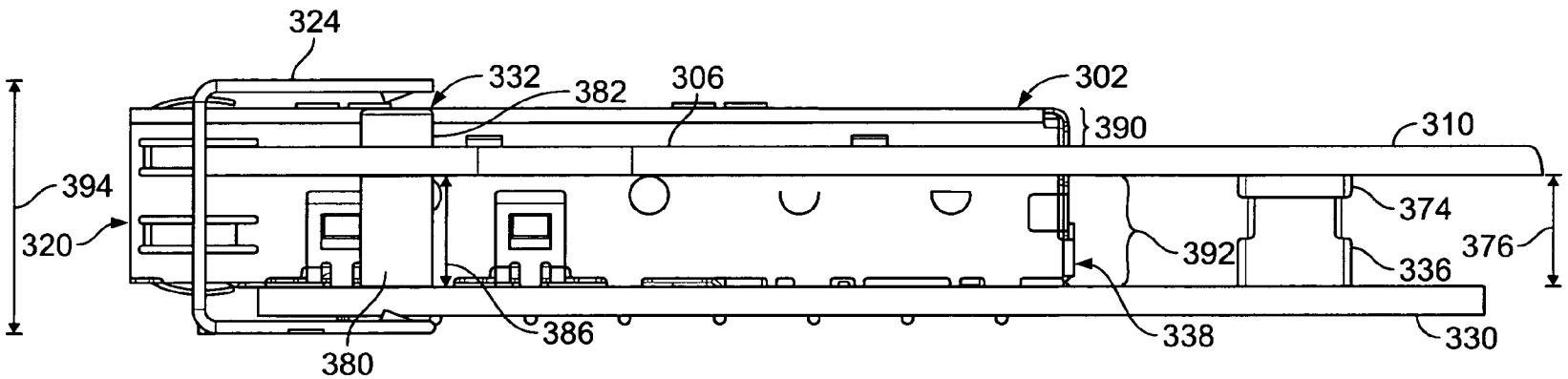
FIG. 10 is a side elevational view of the electrical assembly shown in FIG. 6.

FIG. 9 illustrates an exploded view of the electrical assembly 300. FIG. 10 is a side elevational view of the electrical assembly 300. Pluggable transceiver connectors 370 are mounted on and electrically connected to the adapter board 330. The connectors 370 and the cage assembly 302 are mounted on a common surface 371 of the adapter board 330. Each connector 370 extends upwardly into a respective transceiver cavity 356, 358 when the cage assembly 302 is mounted on the adapter board 330. Each connector 370 is configured to receive a plug-in card edge on a transceiver module (not shown). Apertures or vias 372 are provided in the adapter board 330 to securely receive the mounting pins 362 for mounting the cage assembly 302 on the adapter board.

The connector 374 is mounted on the underside of the main board 310. The connector 374 mates with the connector 336 to electrically connect the main board and adapter board as previously described. The mated combination of the connectors 336 and 374 establishes a spacing 376 between the main and adapter boards 310 and 330, respectively, at the rearward end 338 of the cage assembly 302. A spacer 380 and a fastener 382 comprise the standoff hardware 332 (FIG. 7) proximate the module receiving end 320 of the cage assembly 302. The spacer 380 establishes a spacing 386 between the main board 310 and adapter board 330 proximate the module receiving end 320 of the cage assembly 302. The main board 310 and adapter board 330 are substantially parallel to one another such that the spacings 376 and 386 are the same. The cage assembly 302 is mounted on the adapter board 330 and the spacings 376 and 386 are established such that the cage assembly extends through the cutout 306 in the main board 310. A portion 390 of the cage assembly 302 extends above the main board 310 and a portion 392 of the cage assembly 302 remains below the main board 310.

As previously described, AMC standards define a height 394 of the face plate 324 and also the positioning of the face plate 324 relative to the main board 310. The cage assembly 302 is positioned within the cutout 306 such that the cage assembly 302 is centered in the face plate opening 326 (FIG. 6).

The embodiments thus described provide a cost effective cage assembly that complies with AMC compliant half-height card module standards. The cage assembly has a low profile and is configured to be positioned in a cutout in a circuit board such that a portion of the cage assembly extends through the cutout.

While the invention has been described in terms of various specific embodiments, those skilled in the art will recognize that the invention can be practiced with modification within the spirit and scope of the claims.

What is claimed is:

1. A receptacle assembly for a transceiver module, said receptacle assembly comprising:

a transceiver cage configured to receive the transceiver module and configured to be mounted proximate a cutout in a main circuit board such that a portion of said transceiver cage extends through the cutout;

a connector configured to mate with the transceiver module and disposed within said cage; and an adapter circuit board, wherein said transceiver cage and said connector are configured to be mounted on a common circuit board surface of the adapter circuit board.

2. The receptacle assembly of claim 1, further comprising at least one standoff including a spacer configured to establish a spacing between the main circuit board and the adapter circuit board.

3. The receptacle assembly of claim 1, further comprising a board-to-board connector and a mating connector configured to electrically connect the main circuit board and the adapter circuit board and configured to establish a spacing between the main circuit board and the adapter circuit board.

4. The receptacle assembly of claim 1, wherein the main circuit board and the adapter circuit board are arranged in a substantially parallel relationship.

5. A receptacle assembly for a transceiver module, said receptacle assembly comprising:

a transceiver cage configured to receive said transceiver module and configured to be mounted proximate a cutout in a circuit board such that a portion of said transceiver cage extends through said cutout, said transceiver cage comprising an outer shell and an inner shell, said outer shell having a top wall and opposite side walls, said outer shell configured to be mounted over the cutout in the circuit board, said inner shell having a bottom wall and opposite side walls, said inner shell received within said side walls of said outer shell and attached to said outer shell such that said inner shell extends at least partially through the cutout in the circuit board, said inner and outer shells cooperating to define a cavity configured to receive the transceiver module; and a connector configured to mate with the transceiver module and disposed within said cage, said transceiver cage and said connector being configured to be mounted on a common circuit board surface, wherein at least one spacer is disposed between said side walls of said inner shell and said side walls of said outer shell such that a gap is formed between said inner and outer shells.

6. The receptacle assembly of claim 5, wherein said connector and said outer shell are configured to be mounted on the same side of the circuit board.

7. The receptacle assembly of claim 5, wherein said outer shell includes a slot and said connector includes a housing having a positioning lug received in said slot to orient and hold said connector in said outer shell.

8. The receptacle assembly of claim 5, wherein said outer shell includes mounting pins that are securely held in vias along edges of the cutout to mount said transceiver cage to the circuit board.

9. A receptacle assembly for a transceiver module, said receptacle assembly comprising:

a main circuit board having a cutout defined therein;

a transceiver cage configured to receive the transceiver module and mounted proximate the cutout in said circuit board such that a portion of said transceiver cage extends through the cutout;

a connector configured to mate with the transceiver module and disposed within said transceiver cage; and an adapter circuit board, wherein said transceiver cage and said connector are configured to be mounted on a common circuit board surface of the adapter circuit board.

10. The receptacle assembly of claim 9, further comprising at least one standoff including a spacer configured to establish a spacing between the main circuit board and the adapter circuit board.

11. The receptacle assembly of claim 9, further comprising a board-to-board connector and a mating connector configured to electrically connect the main circuit board and the adapter circuit board and configured to establish a spacing between the main circuit board and the adapter circuit board.

12. The receptacle assembly of claim 9, wherein the main circuit board and the adapter circuit board are arranged in a substantially parallel relationship.

13. A receptacle assembly for a transceiver module, said receptacle assembly comprising:

a circuit board having a cutout defined therein;

a transceiver cage configured to receive the transceiver module and mounted proximate the cutout in said circuit board such that a portion of said transceiver cage extends through the cutout, said transceiver cage comprising an outer shell and an inner shell, said outer shell having a top wall and opposite side walls, said outer shell configured to be mounted over the cutout in the circuit board, said inner shell having a bottom wall and opposite side walls, said inner shell received within said side walls of said outer shell and attached to said outer shell such that said inner shell extends at least partially through the cutout in the circuit board, wherein said inner and outer shells cooperate to define a cavity configured to receive the transceiver module;

a connector configured to mate with the transceiver module and disposed within said transceiver cage, said transceiver cage and said connector being configured to be mounted on a common circuit board surface, wherein said outer shell includes a slot and said connector includes a housing having a positioning lug received in said slot to orient and hold said connector in said outer shell.

14. The receptacle assembly of claim 13, wherein said connector and said outer shell are configured to be mounted on the same side of the circuit board.

15. The receptacle assembly of claim 13, wherein at least one spacer is disposed between said side walls of said inner shell and said side walls of said outer shell such that a gap is formed between said inner and outer shells.

16. The receptacle assembly of claim 13, wherein said outer shell includes mounting pins that are securely held in vias along edges of the cutout to mount said transceiver cage to the circuit board.

* * * * *